US007252116B2

(12) United States Patent
Miyazoe et al.

(10) Patent No.: US 7,252,116 B2
(45) Date of Patent: Aug. 7, 2007

(54) COUPLING SOLENOID VALVE

(75) Inventors: Shinji Miyazoe, Tsukuba-gun (JP); Katsuyuki Senba, Tsukuba-gun (JP)

(73) Assignee: SMC Corporation, Tokyo (JP)

( * ) Notice: Subject to any disclaimer, the term of this patent is extended or adjusted under 35 U.S.C. 154(b) by 396 days.

(21) Appl. No.: 11/054,442

(22) Filed: Feb. 10, 2005

(65) Prior Publication Data

US 2005/0236054 A1 Oct. 27, 2005

(30) Foreign Application Priority Data

Apr. 22, 2004 (JP) ..... 2004-127127

(51) Int. Cl.
*F15B 13/043* (2006.01)

(52) U.S. Cl. ..... 137/625.64; 137/271; 137/884; 251/26

(58) Field of Classification Search ..... 137/625.64, 137/269, 271, 884; 251/26, 129.03
See application file for complete search history.

(56) References Cited

U.S. PATENT DOCUMENTS 5,437,306 A * 8/1995 Asou et al. ..... 137/625.64
5,529,088 A * 6/1996 Asou ..... 137/271
5,558,126 A * 9/1996 Hayashi et al. ..... 137/625.64
5,597,015 A * 1/1997 Asou et al. ..... 137/625.64
5,664,604 A * 9/1997 Sato et al. ..... 137/884
5,699,834 A * 12/1997 Hayashi et al. ..... 137/884
5,725,255 A * 3/1998 Hayashi et al. ..... 137/625.64
5,845,679 A * 12/1998 Hayashi et al. ..... 137/625.64
6,164,335 A * 12/2000 Hayashi et al. ..... 137/884
6,776,192 B2 * 8/2004 Wigmore ..... 137/884
6,892,749 B2 * 5/2005 Fukano et al. ..... 137/884
6,892,763 B2 * 5/2005 Burkhardt et al. ..... 137/884

FOREIGN PATENT DOCUMENTS

JP 10-47509 2/1998

* cited by examiner

*Primary Examiner*—John Rivell
(74) *Attorney, Agent, or Firm*—Oblon, Spivak, McClelland, Maier & Neustadt, P.C.

(57) ABSTRACT

A coupling solenoid valve, of which both side faces in the valve-width direction are coupling faces for coupling another solenoid valve, including a main valve unit for switching a fluid channel using a spool, and a solenoid operating unit for driving the spool, wherein a housing of the main valve unit is divided into plurality of blocks, a valve hole for accommodating the spool is formed in a center block, a bottom block is made up of a synthetic resin, plurality of coupling communication holes are formed in this bottom block, and also a connection tube is formed in an integrated manner.

12 Claims, 6 Drawing Sheets

COUPLING SOLENOID VALVE

TECHNICAL FIELD

The present invention relates to a coupling solenoid valve, and more specifically relates to a coupling solenoid valve to be used in a solenoid valve assembly form by mutually connecting a plurality of solenoid valves.

PRIOR ART

A technique using a plurality of solenoid valves mutually connected in a solenoid valve assembly form has been conventionally known as disclosed in Patent Document No. 1 for example. This kind of solenoid valve assembly generally comprises plurality of solenoid valves including coupling communication holes to be mutually connected by coupling, a port block including integrated air-supply/discharge ports, a connector block including an integrated power-supply electrical connector, and an end block to be disposed as necessary, which are mounted on a rail in array.

With coupling solenoid valves to be employed for such a solenoid valve assembly, plurality of coupling communication holes for air supply and discharge passing through the housing thereof in the valve-width direction are normally formed in the housing, and the corresponding coupling communication holes are mutually connected when plurality of solenoid valves are coupled. At this time, a connection tube is introduced to ensure connection of the coupling communication holes, one half side of this connection tube is inserted in the coupling communication hole of the one solenoid valve, and the other half side thereof is inserted in the coupling communication hole of another solenoid valve.

However, the connection tube is formed independently from the solenoid vales, and is simply inserted in the coupling communication holes, and accordingly, readily comes out of the coupling communication holes, and readily drops out and is often lost at the time of assembling a solenoid valve assembly by coupling plurality of solenoid valves or at the time of disassembling a solenoid valve assembly for maintenance and inspection, and so forth, which has been a hindrance to the aforementioned work.

Also, it is necessary for a large-diameter valve hole for accommodating a spool for switching a channel to be formed in the axial direction of the housing, i.e., in the direction orthogonal to the coupling communication holes as well as the plurality of coupling communication holes, and this valve hole communicates with the plurality of coupling communication holes through plurality of communication channels, or an output port provided on another position communicates with the valve hole through an individual communication channel, and accordingly, it has been very difficult to position the valve hole, coupling communication holes, communication channels, and so forth, without competing for position, and also to work on these.

Patent Document 1: Publication of Japanese Application No. 10-47509

DISCLOSURE OF THE INVENTION

Accordingly, it is an object of the present invention to facilitate design and work of solenoid valves and also to improve workability at the time of assembling and disassembling a solenoid valve assembly by forming the valve hole, coupling communication holes, communication channels, and so forth in a distributed manner on plurality of members, and also by configuring a connection tube for connecting the coupling communication hole so as not to come out of the coupling communication hole easily, with a coupling solenoid valve to be used in a solenoid valve assembly form by mutually connecting plurality of solenoid valves.

In order to achieve the aforementioned object, the present invention provides a coupling solenoid valve of which both side faces in the valve-width direction correspond to a first coupling face and a second coupling face for being coupled with another solenoid valve, including a main valve unit including plurality of coupling communication holes passing through in the valve-width direction, a valve hole through which the coupling communication holes mutually communicate, and a spool for switching a channel accommodated within the valve hole; and a solenoid operating unit connected with the main valve unit. The housing of the main valve unit is divided into plurality of blocks having essentially the same horizontal width, and includes a center block positioned in the center, and a synthetic resin bottom block connected to the bottom of the center block, the valve hole extending in the axial direction of the main valve unit is formed in the center block, the plurality of coupling communication holes are formed in the bottom block, and also a connection tube protruding from the respective coupling communication holes to one coupling face side is integrally formed in the bottom block, and further, circular seal members are applied on the position of the other coupling face side within the respective coupling communication holes, and the corresponding coupling communication holes are connected in an airtight manner by the connection tube and seal members of the adjacent solenoid valves being fitted to each other when plurality of solenoid valves are coupled.

Preferably with the present invention, the bottom block comprises: circular recessed groove portions surrounding each connection tube on the coupling face on the side in which the connection tube is provided; and circular protruding wall portions surrounding the respective coupling communication holes on the coupling face on the opposite side; wherein the protruding wall portions and the recessed groove portions of the adjacent solenoid valves are mutually fitted when plurality of solenoid valves are coupled.

Also, with the present invention, the center block includes an end wall portion extending downward on a first end side in the axial direction, and the bottom block is connected to the center block so as to be positioned in the axial direction by one end of the bottom block being in contact with the end wall portion.

Preferably in this case, steps having a different height in the valve-width direction are formed on the face with which the end wall portion and the bottom block are mutually in contact, and the bottom block is positioned in the valve-width direction due to contact of these steps.

Also, with the present invention, an output block including output ports is attached to the first end side of the center block, a manual block including manual buttons for switching the spool manually is attached to the second end of the opposite side, and the solenoid operating unit is coupled with the center block via this manual block.

Thus, according to the coupling solenoid valve of the present invention, the valve hole and the coupling communication holes are formed so as to be distributed to plurality of blocks such as an arrangement wherein the housing of the main valve unit is divided into the plurality of blocks, the valve hole is formed in the center block, and the plurality of coupling communication holes are formed in the bottom block, thereby facilitating the displacements of the valve hole and coupling communication holes, and also simplifying work of these as compared to the case in which the valve hole, coupling communication holes, and communication channels connecting these holes are disposed in one block in a concentrated manner and worked.

Also, the bottom block is made up of a synthetic resin, and the connection tube for connecting the coupling communication hole is integrally formed, thereby preventing this connection tube from coming out of the coupling communication hole, and also improving workability at the time of assembling and disassembling a solenoid valve assembly.

DESCRIPTION OF THE PREFERRED EMBODIMENTS

Figure 1:
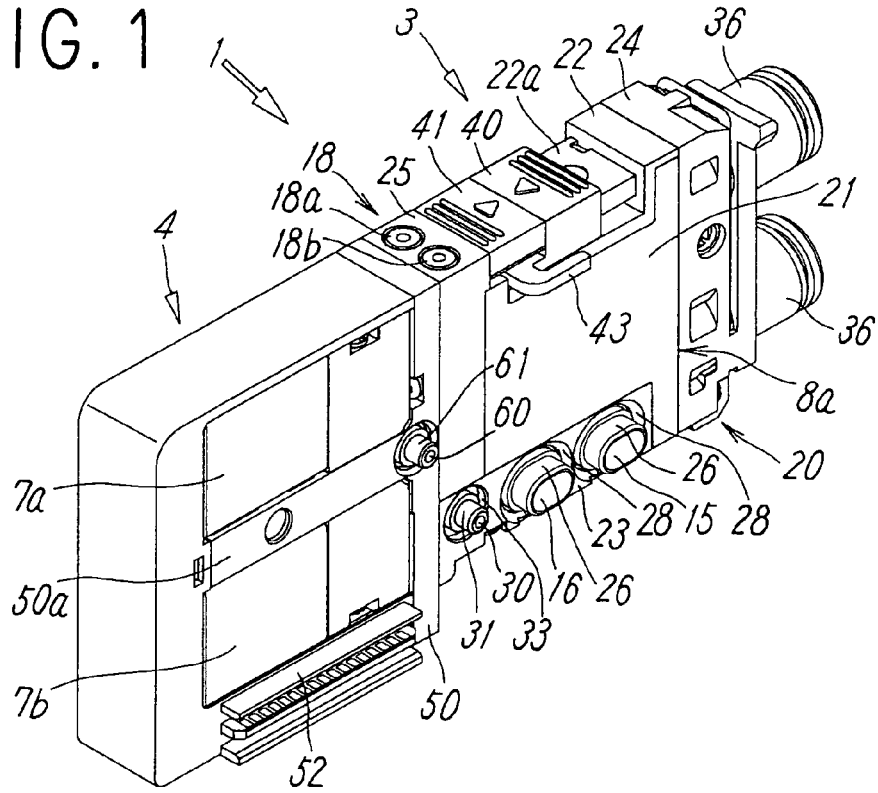
FIG. 1 is a perspective view of a coupling solenoid valve according to the present invention as viewed from a first coupling face side.
Figure 2:
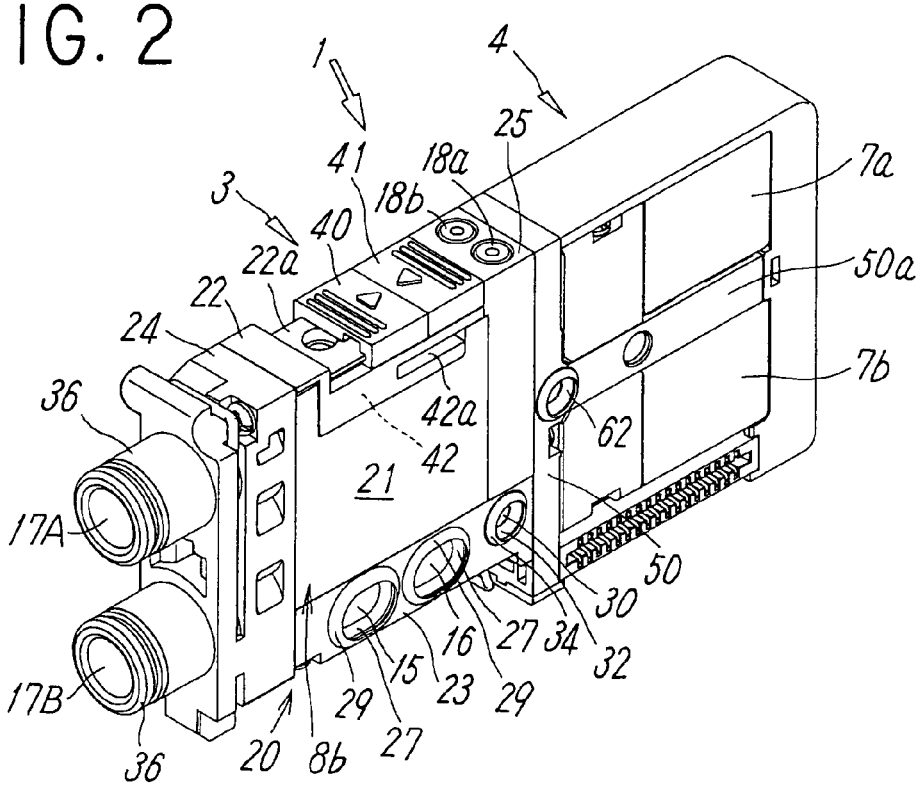
FIG. 2 is a perspective view of the solenoid valve in FIG. 1 as viewed from a second coupling face side.

FIG. 1 and FIG. 2 illustrate an embodiment of a coupling solenoid valve according to the present invention. This solenoid valve 1 includes, as can be understood from FIG. 3 and FIG. 4, a main valve unit 3 configured so as to switch an air channel using a spool 6, and a pilot-type solenoid operating unit 4 connected to one end side of this main valve unit 3 in the axial direction (longitudinal direction), and is a double-pilot-type solenoid valve for controlling pilot air using two pilot valves 7*a* and 7*b* of this solenoid operating unit 4 to drive the spool 6. Also, both side faces of this solenoid valve 1 in the valve-width direction (horizontal-width direction) correspond to a practically flat first coupling face 8*a* and a practically flat second coupling face 8*b* for coupling another solenoid valve 1.

The main valve unit 3 having a 5-port-type valve configuration comprises a valve hole 10 extending in the axial direction, five air openings 11, 12A, 12B, 13A, and 13B for supply, output, and discharge, each of which mutually opens at a position different from the valve hole 10, the spool 6, which is slidably inserted in the valve hole 10, for switching a channel between these air openings, two pistons 14*a* and 14*b*, which are in contact with both ends of the spool 6 in the axial direction and are driven by pilot air supplied from the solenoid operating unit 4, for switching the spool 6, plurality of coupling communication holes 15 and 16 passing through the main valve unit 3 in the valve-width direction, two output ports 17A and 17B provided on the end face of the opposite side of the side where the solenoid operating unit 4 of the main valve unit 3 is connected, and a manual operating portion 18 including two manual buttons 18*a* and 18*b* capable of switching the spool 6.

The example illustrated in the drawings is provided with the two coupling communication holes 15 and 16, wherein one, i.e., the coupling communication hole 15 is for main air supply and the other, i.e., the coupling communication hole 16 is for main air discharge. The coupling communication hole 15 for supply is connected to the air opening 11 for supply via a branch hole 11*a*, and the coupling communication hole 16 for discharge is connected to the two air openings 13A and 13B for discharge via branches 13*a* and 13*b* in common. However, an arrangement may be made wherein the two coupling communication holes 16 for discharge are provided, and one is connected to the air opening 13A for discharge and the other is connected to the air opening 13B for discharge. Also, the output port 17A is connected to the air opening 12A for output via an output communication hole 12*a*, and the output port 17B is connected to the air opening 12B for output via an output communication hole 12*b*.

A housing 20 of the main valve unit 3 is divided into plurality of blocks having essentially the same horizontal width. More specifically, the housing 20 includes a center block 21 positioned in the center of the housing 20, a top block 22 connected to the upper end portion of the center block 21, a bottom block 23 connected to the lower end portion of the center block 21, an output block 24 connected to a first end side of the center block 21 in the axial direction (longitudinal direction), and a manual block 25 connected to a second end side serving as the opposite side of the center block 21, and is formed by connecting these blocks having a rectangular cross-sectional shape within both coupling faces 8*a* and 8*b* without offset so as to assume a generally rectangular longitudinal cross-sectional shape as a whole.

The center block 21, which is made up of a metal material such as aluminum, includes an end wall portion 21*a* extending upward and an end wall portion 21*b* extending downward on the first end side of the axial direction. The top block 22 and the bottom block 23, which are molded of a synthetic resin, are fixed to the center block 21 with screws 22*d* and 23*a* in a state in which the top block 22 and the bottom block 23 are positioned in the axial direction by one end thereof being in contact with the end wall portions 21*a* and 21*b*.

Of the end wall portions 21*a* and 21*b*, the upper end wall portion 21*a* is formed in the same width as the center block 21, but the lower-side end wall portion 21*b* is not formed in the same width as the center block 21, and is partially formed inclined to the first coupling face 8*a* side. A step 21*c* of which height is different in the valve-width direction is formed on the lower-side end wall portion 21*b* by reducing the wall thickness at the first coupling face 8*a* side half so as to be smaller than the wall thickness at the second coupling face 8*b* side half. On the other hand, a step 23*b* of which height is different in the opposite direction as to the step 21*c* of the end wall portion 21*b* is formed on the end face of the bottom block 23, the bottom block 23 is positioned in the valve-width direction, i.e., in the directions of both coupling faces 8*a* and 8*b* as to the center block 21 by engaging the step 23*b* with the step 21*c*. Note that the upper-side end wall portion 21*a* may be formed in the same width as the center block 21.

The valve hole 10 extending in the axial direction is formed within the center block 21, and the coupling communication holes 15 and 16 are formed within the bottom block 23. Each of the coupling communication holes 15 and 16 includes a connection tube 26 protruding on the first coupling face 8*a* side, and a circular seal member 27 applied within the communication hole on the second coupling face 8*b* side, and in the event that the plurality of solenoid valves 1 are coupled, the corresponding coupling communication holes 15 and the corresponding coupling communication holes 16 are connected in an airtight manner respectively by mutually fitting the connection tube 26 and seal member 27 of the adjacent solenoid valves 1.

The connection tube 26 is considered so as not to separate and fall from the bottom block 23 by molding the connection tube 26 integrally with the synthetic resin bottom block 23. Accordingly, the connection tube 26 does not cause a problem wherein the conventional connection tube readily comes off and is lost at the time of assembling a solenoid valve assembly by coupling plurality of solenoid valves, at the time of disassembling this solenoid valve assembly for maintenance and inspection, and so forth, and provides an advantage over workability.

Also, with the bottom block 23, circular recessed groove portions 28 surrounding each connection tube 26 are formed on the side face of the first coupling face 8*a* side, also circular protruding wall portions 29 surrounding the respective coupling communication holes 15 and 16 are formed on the side face of the second coupling face 8*b* side, and the protruding wall portions 29 and the recessed groove portions 28 of the adjacent solenoid valves 1 and 1 are mutually fitted when the plurality of solenoid valves 1 are coupled, thereby coupling the solenoid valves in a sure manner, and also connecting the respective coupling communication holes in a sure manner.

A pilot supply communication hole 30 passing through in the valve-width direction is further formed within the bottom block 23, and this pilot supply communication hole 30 communicates with the two pilot valves 7*a* and 7*b* of the solenoid operating unit 4 and the manual operating portion 18 via a pilot branch hole omitted in the drawings. This pilot supply communication hole 30 includes a connection tube 31, which is formed integrated with the bottom block 23, protruding on the first coupling face 8*a* side, a circular seal member 32 applied within the communication hole on the second coupling face 8*b* side, a circular recessed groove portion 33 surrounding the connection tube 31, and a circular protruding wall portion 34 surrounding the pilot supply communication hole 30 on the second coupling face 8*b* side, and in the event that the plurality of solenoid valves 1 are coupled, the corresponding pilot supply communication holes 30 are connected in an airtight manner by mutually fitting the connection tube 31 and seal member 32, and the recessed groove portion 33 and protruding wall portion 34 of the adjacent solenoid valves 1, in the same way as the case of the coupling communication holes 15 and 16.

Thus, the housing 20 of the main valve unit 3 is divided into plurality of blocks, the valve hole 10 is provided within the center block 21, and the coupling communication holes 15 and 16 and the pilot supply communication hole 30 are formed within the bottom block 23, thereby facilitating displacement and manufacturing of channels connecting between the respective coupling communication holes 15 and 16 and the valve hole 10, manufacturing of plurality of branch holes connecting between the pilot supply communication hole 30 and the pilot valves 7*a* and 7*b*, and so forth as well as displacement and manufacturing of the valve hole and the respective communication holes, as compared to the case in which the valve hole and the respective communication holes are manufactured in a concentrated manner as one block. Moreover, molding the bottom block 23 of a synthetic resin further facilitates manufacturing thereof. In addition, the connection tubes 26 and 31 and the seal members 27 and 32 are provided on both sides of the respective coupling communication holes 15 and 16 and the pilot supply communication hole 30, and the connection tube and seal member of the adjacent solenoid valves 1 are mutually fitted, thereby improving airtightness at the time of connecting the coupling communication holes 15, the coupling communication holes 16, or the pilot supply communication holes 30.

With the output block 24 and the manual block 25 each of which a piston chamber is formed, the piston chamber of the output block 24 accommodates the piston 14*a*, and the piston chamber of the manual block 25 accommodates the piston 14*b*. Also, a pilot pressure chamber 35*a* is provided on the back face of the piston 14*a*, and a pilot pressure chamber 35*b* is provided on the back face of the piston 14*b*, and these pilot pressure chambers 35*a* and 35*b* communicate with the pilot valves 7*a* and 7*b* and the pilot supply communication hole 30, which are the corresponding one side thereof, by means of individual pilot output channels omitted in the entire drawing via the manual buttons 18*a* and 18*b*, which are the corresponding other side thereof, respectively. In the example illustrated in the drawing, the diameters of the two pistons 14*a* and 14*b* are different in size, i.e., the diameter of the first piton 14*a* is greater than the diameter of the second piston 14*b*, but an arrangement may be made wherein these are the same in size.

Figure 3:
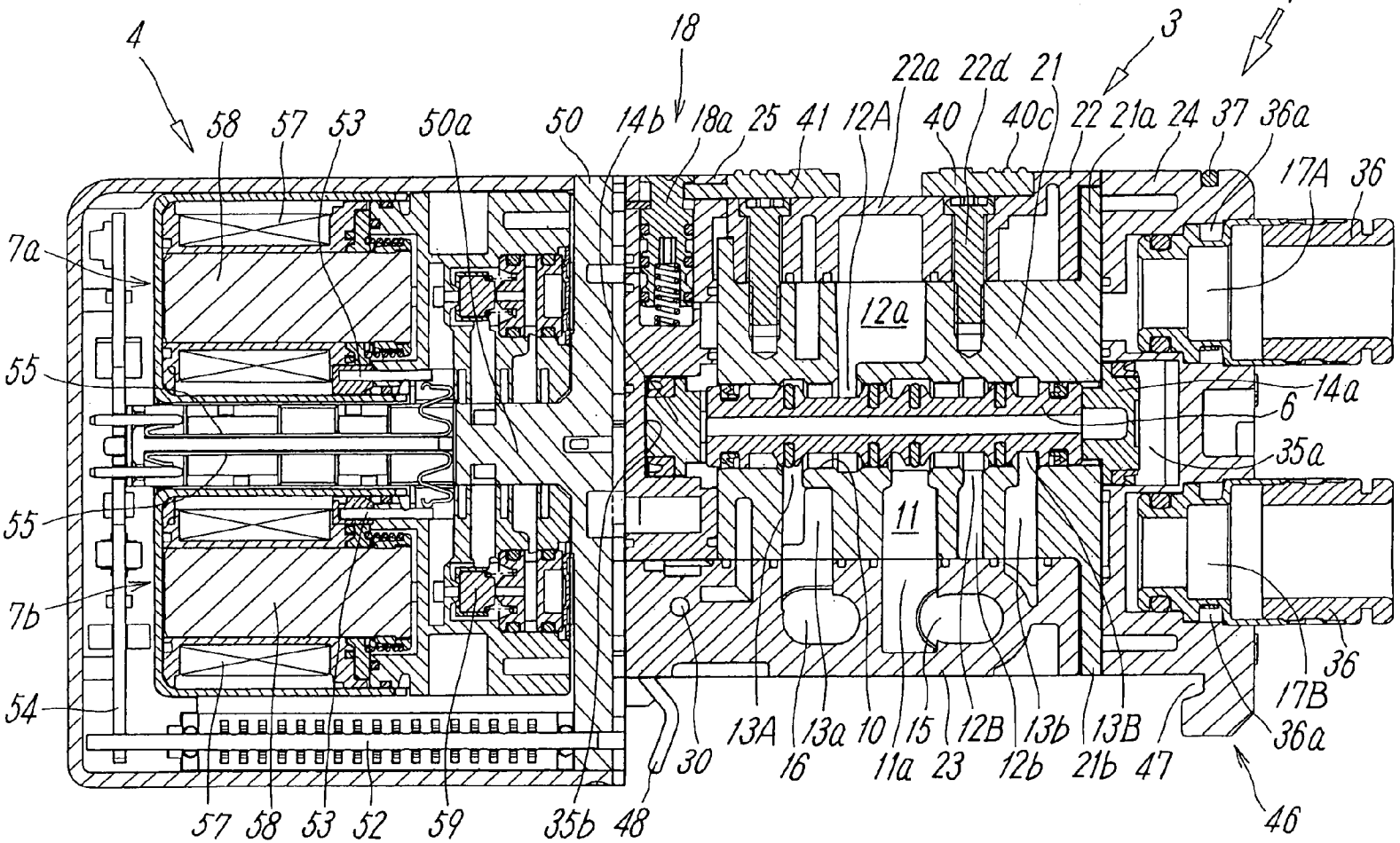
FIG. 3 is a cross-sectional view of the solenoid valve in FIG. 1.
Figure 4:
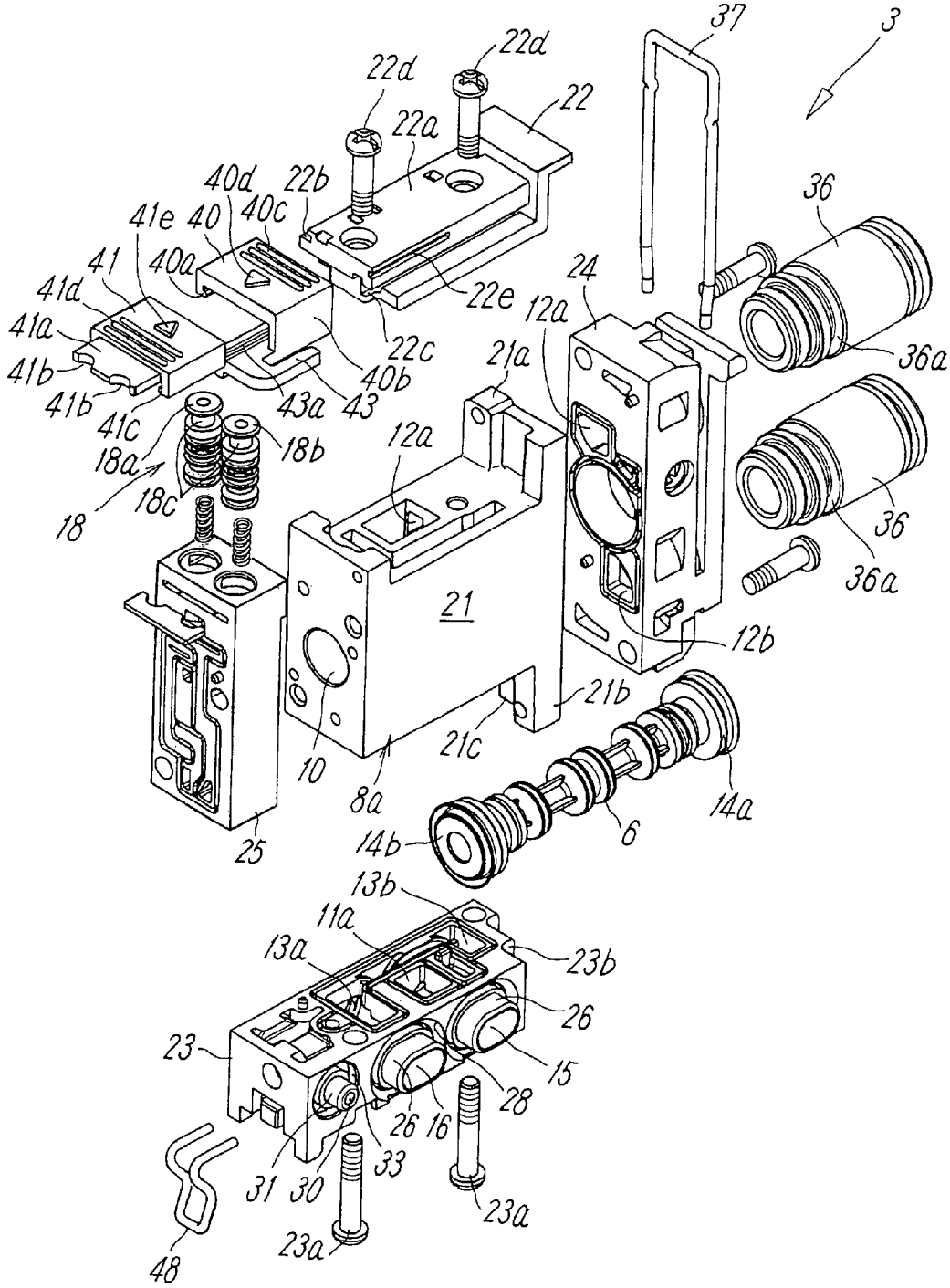
FIG. 4 is a perspective view illustrating a disassembled main valve unit of the solenoid valve in FIG. 1.

Upon the first pilot valve 7*a* on one side being activated so as to supply pilot air to the first pilot pressure chamber 35*a*, the spool 6 moves to the first switching position in FIG. 3 due to actions of the first piston 14*a*, the air opening 11 for supply communicates with the second air opening 12B for output so as to abstract air output from the second output port 17B, and also the first air opening 12A for output communicates with the first air opening 13A for discharge so as to place the first output port 17A in a ventilating state. Conversely, upon the second pilot valve 7*b* on the other side being activated so as to supply pilot air to the second pilot pressure chamber 35*b*, the spool 6 moves to the second switching position opposite from the first switching position in FIG. 3 due to actions of the second piston 14*b*, the air opening 11 for supply communicates with the first air opening 12A for output so as to abstract air output from the first output port 17A, and also the second air opening 12B for output communicates with the second air opening 13B for discharge so as to place the second output port 17B in a ventilating state.

A quick-connection-type tube joint 36, which can connect a piping tube in a state safe from falling out simply by inserting the tube thereto, is attached to the output ports 17A and 17B formed within the output block 24 respectively. This tube joint 36 having a locking groove 36*a* on the perimeter thereof is attached to the output ports 17A and 17B respectively so as to prevent the connection tube from dropping off by locking this locking groove 36*a* with a U-shaped clip 37 mounted in the output block 24.

The manual operating portion 18 is for reproducing a switching state with the pilot valves 7*a* and 7*b* by means of manual operations, and includes the two manual buttons 18*a* and 18*b* disposed in array on the top face of the manual block 25 in the valve-width direction, wherein the first manual button 18*a* corresponds to the first pilot valve 7*a*, and the second manual button 18*b* corresponds to the second pilot valve 7*b*. Upon the first manual button 18*a* being depressed, the pilot supply communication hole 30 directly communicates with the first pilot pressure chamber 35*a* through a pilot output channel without passing through the first pilot valve 7*a*, on the other hand, upon the second manual button 18*b* being depressed, the pilot supply communication hole 30 directly communicates with the second pilot pressure chamber 35*b* through a pilot output channel without passing through the second pilot valve 7*b*.

The top block 22 includes a flat rail-shaped guide 22*a* extending in the axial direction of the main valve unit 3 on the top face thereof. A binding member 40 and safety member 41, which are adjacent to each other, are assembled on the guide 22*a* so as to move along the guide 22*a*, and can be operated from the top face of the solenoid valve 1 independently. As can be understood from FIG. 2 and FIG. 5, a hook-engaging portion 42 extending in the axial direction of the main valve unit 3 is provided on the somewhat lower position than the guide 22*a* on the side face of the second coupling face 8*b* side of the top block 22, and a hook insertion opening 42*a* is opened on the second coupling face 8*b* adjacent to the engaging portion 42.

The binding member 40 serving as a groove-shaped member is mounted on the guide 22*a* so as to overstride the guide 22*a*, and a locking protrusion 40*a* and a hook supporting wall 43*a*, which are formed inward as to the side face of the binding member 40, are engaged with locking grooves 22*b* and 22*c* of both side faces of the guide 22*a*. A side wall portion 40*b* extending downward is formed on one side face of the binding member 40, i.e., on the side face of the first coupling face 8*a* side, and a hook 43 for engaging is integrally formed on the lower end portion of the side wall portion 40*b* via the hook supporting wall 43*a*. This hook supporting wall 43*a* is formed so as to extend in the horizontal direction toward the inner side of the binding member 40 in the width direction, on the lower end portion of the side wall portion 40*b*, and also so as to extend to the safety member 41 side with one end thereof, the hook 43 is formed so as to protrude toward outside the side face of the housing 20 once on the end portion of the hook supporting wall 43*a* extending to the safety member 41 side, and then extend in the axial direction of the housing 20 along the side wall portion 40*b*. This hook 43 is for engaging with the engaging portion 42 of the adjacent solenoid valve 1 at the time of coupling plurality of solenoid valves 1.

Figure 5:
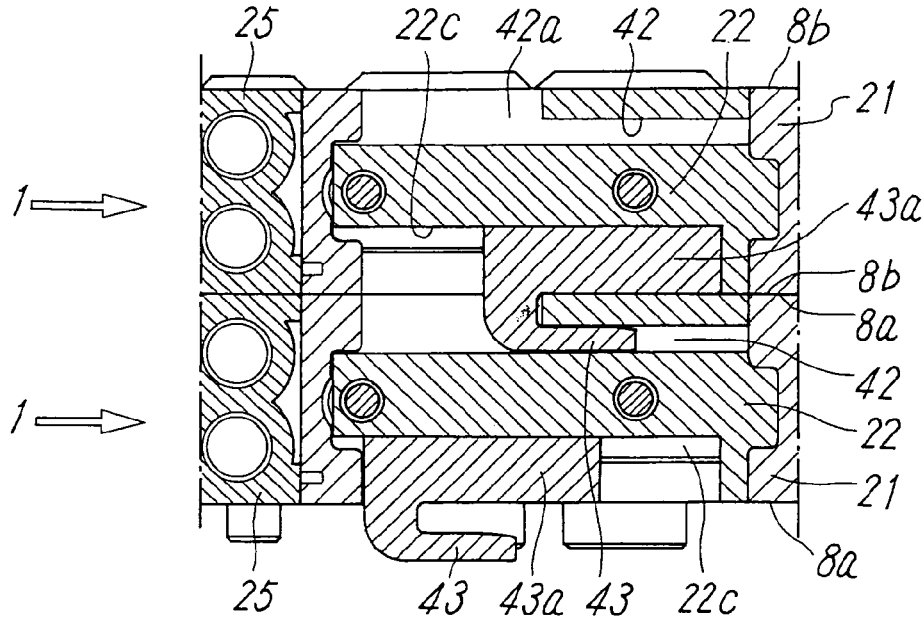
FIG. 5 is a cross-sectional view of the principal components in a state in which two adjacent solenoid valves are coupled.

The binding member 40 is configured so as to control the hook 43 to move between the binding position to be engaged with the engaging portion 42 of the adjacent solenoid valve 1 (solenoid valve 1 illustrated at the upper side in FIG. 5) and the separating position to be disengaged from this engaging portion 42 (solenoid valve 1 illustrated at the lower side in FIG. 5). Plurality of protrusions 40*c* for preventing the finger from slipping at the time of operations, and an arrow 40*d* indicating the operating direction toward the separating position are provided on the top face of the binding member 40.

The safety member 41 serving as a groove-shaped member is mounted on the guide 22*a* so as to overstride the guide 22*a*, and a locking protrusion 41*c*, which is formed inward as to both side faces of the safety member 41, is engaged with locking grooves 22*b* and 22*e* of both side faces of the guide 22*a*. A locking wall 41*a* extending in the horizontal direction is formed on one end of the safety member 41, i.e., one end portion of the solenoid operating unit 4 side, and two recessed portions 41*b* and 41*b* capable of fitting and locking the grooves 18*c* of the two manual buttons 18*a* and 18*b* are formed on the tip portion of the locking wall 41*a*. Similarly, plurality of protrusions 41*d* for preventing the finger from slipping at the time of operations, and an arrow 41*e* indicating the operating direction, are provided on the top face of the safety member 41.

Figure 6:
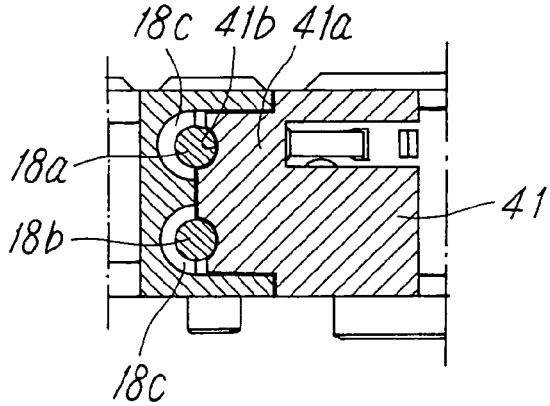
FIG. 6 is a cross-sectional view of the principal components in a state in which a safety member locks manual buttons.
Figure 7:
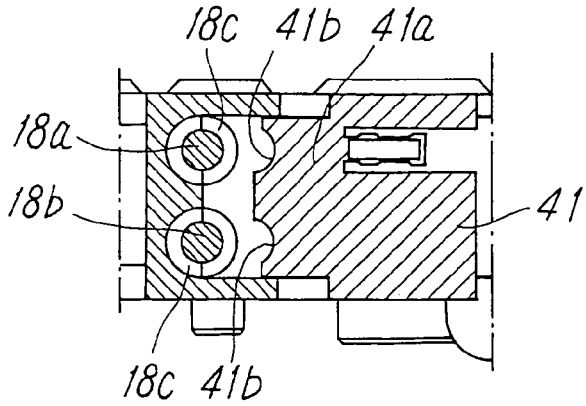
FIG. 7 is a cross-sectional view of the principal components in a state in which the safety member moves toward a position where the locked manual buttons are released.

This safety member 41 is disposed on the position adjacent to the binding member 40, and in the event that this binding member 40 is positioned on the separating position, as illustrated in FIG. 1 and FIG. 6, the two recessed portions 41*b* and 41*b* of the tip of the locking wall 41*a* are pressed by the binding member 40 so as to move to the position for locking the groove portions 18*c* of the two manual buttons 18*a* and 18*b* in an inoperable state. On the other hand, in the event that the binding member 40 is positioned on the binding position as illustrated in FIG. 3, the two manual buttons 18*a* and 18*b* are released from the binding member 40, and the two recessed portions 41*b* and 41*b* are capable of disengaging from the manual buttons 18*a* and 18*b* so as to move to the position for releasing the locked state as illustrated in FIG. 7.

Figure 8:
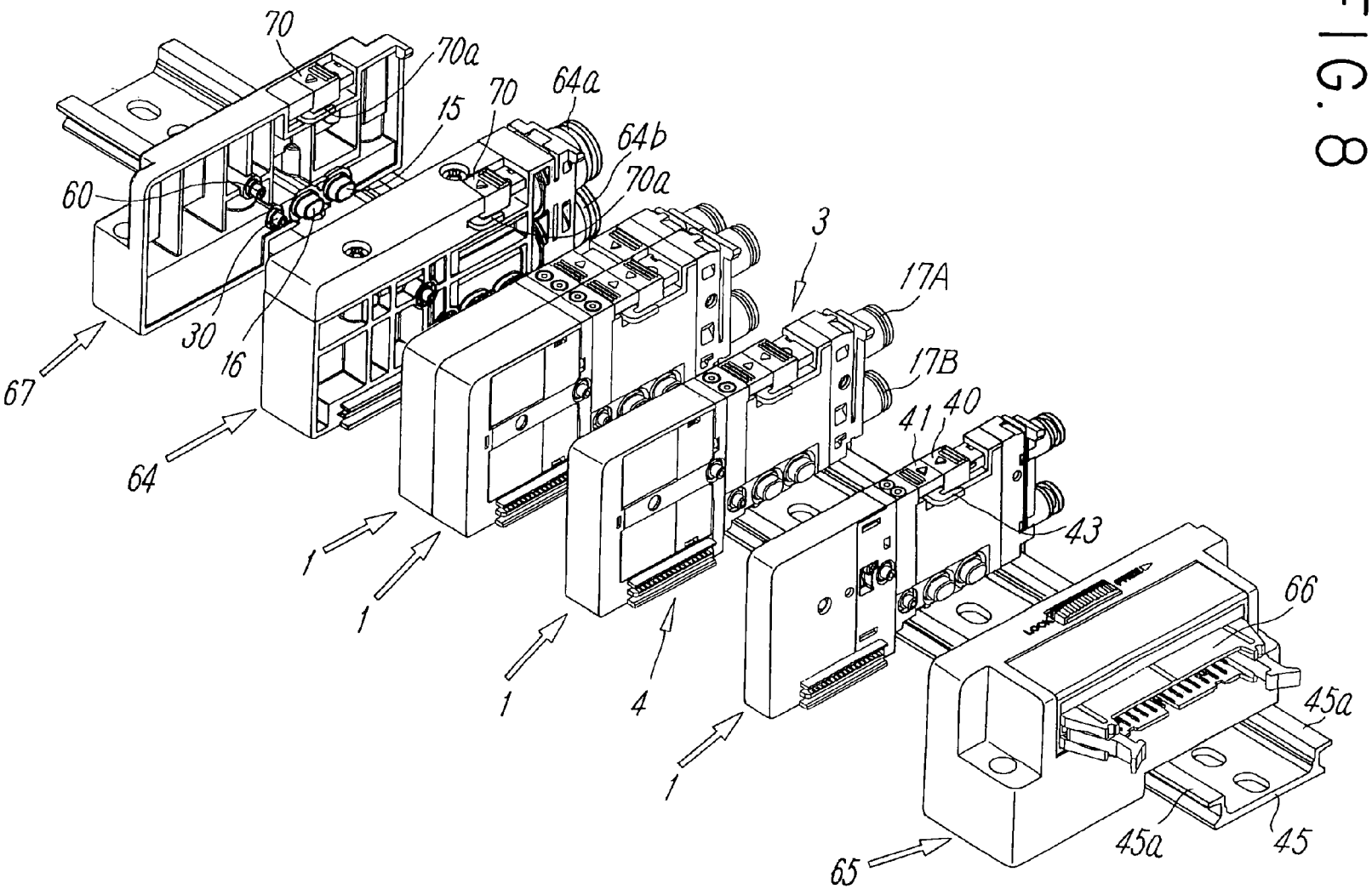
FIG. 8 is a perspective view illustrating a process on the way to formation of solenoid valve assembly by mounting the solenoid valve in FIG. 1 on a rail.

A recessed rail attachment portion 46 capable of fitting to a rail 45 is formed on the bottom face of the main valve unit 3. This rail attachment portion 46 includes an attachment groove 47 formed on the lower end portion of the output block 24, and a rail clip 48 provided on the lower end portion of the bottom block 23, and these attachment groove 47 and rail clip 48 are retained by flange portions 45*a* on both side ends of the rail 45, thereby mounting the solenoid valve 1 on the rail 45, as illustrated in FIG. 8. Note that the rail 45 is a DIN rail.

The solenoid operating unit 4 includes the housing 20 of the main valve unit 3, i.e., an adapter block 50 coupled with the manual block 25 and the bottom block 23 with screws. This adapter block 50 includes an intermediate base 50*a* extending in the horizontal direction from the intermediate position thereof, and the first pilot valve 7*a* and the second pilot valve 7*b* are attached on both the upper and lower faces of the intermediate base 50*a*. The adapter block 50 is attached with an electrical connector 52 for coupling having plurality of terminals, and part of the terminals of this electrical connector 52 and each coil terminal 53 of the pilot valves 7*a* and 7*b* are electrically connected via a printed board 54 and an electroconductive fitting 55.

The electrical connector 52 is configured so as to mutually electrically connect to the electrical connector of the adjacent solenoid valve 1 at the time of coupling plurality of solenoid valves 1, and is employed for supply and for signal transmission.

The pilot valves 7*a* and 7*b* include exciting coils 57, a movable iron core 58 displaced due to magnetic force generated at the time of turning on the exciting coils 57, and a valve member 59 opening/closing a pilot valve sheet, which is driven by the movable iron core 58. These pilot valves 7*a* and 7*b* are disposed such that the axial direction thereof, i.e., the movement direction of the movable iron core 58, is parallel to the axial direction of the main valve unit 3, i.e., the movement direction of the spool 6. Binding the main valve unit 3 with the solenoid operating unit 4 in such a direction can suppress the height of the main valve unit 3 lower than the case in which the spool 6 is disposed in the vertical direction, i.e., in the direction orthogonal to the movement direction of the movable iron core 58, and accordingly, the same vibration direction can be obtained at the time of moving the movable iron core 58 and at the time of moving the spool 6 as well as convenience for reduction in size, resulting in facilitating vibration control of these as an advantage.

The output opening of the first pilot valve 7*a* communicates with the first pilot pressure chamber 35*a*, the output opening of the second pilot valve 7*b* communicates with the second pilot pressure chamber 35*b*, the input openings of both pilot valves 7*a* and 7*b* communicate with the pilot supply communication hole 30 in common, and the discharge openings of both pilot valves 7*a* and 7*b* communicate with a pilot discharge communication hole 60 in common. When the first pilot valve 7*a* is turned on, pilot air from the pilot supply communication hole 30 is supplied to the first pilot pressure chamber 35*a* so as to drive the first piston 14*a*, on the other hand, when the second pilot valve 7*b* is turned on, pilot air from the pilot supply communication hole 30 is supplied to the second pilot pressure chamber 35*b* so as to drive the second piston 14*b*.

Note that the configurations of the pilot valves 7*a* and 7*b* are known, and do not directly relate to the essence of the present invention; accordingly, further detailed description regarding the configurations thereof will be omitted.

The pilot discharge communication hole 60 is formed within the adapter block 50 so as to pass through the block in the valve-width direction, includes a connection tube 61 protruding on the first coupling face 8*a* side, and a circular seal member 62 applied within the communication hole on the second coupling face 8*b* side in the same way as with the pilot supply communication hole 30, and when plurality of solenoid valves 1 are coupled, the pilot discharge communication holes 60 are connected in an airtight manner by the connection tube 61 and seal member 62 of the adjacent solenoid valves 1 mutually fitting.

The aforementioned embodiment relates to the double-pilot-type solenoid valve including the two pilot valves 7*a* and 7*b*, but the present invention may be similarly applied to a single-pilot-type solenoid valve including only the first pilot valve 7*a*. This single-pilot-type solenoid valve can be provided by omitting the second pilot valve 7*b* corresponding to the small-diameter second piston 14*b* and the second manual button 18*b* in the double-pilot-type solenoid valve, or by locking these in an inoperative state and communicating the second pilot pressure chamber 35*b* with the pilot supply communication hole 30 all the time. More specifically, a single-pilot-type solenoid valve including essentially the same outer shape as the double-pilot-type solenoid valve can be provided by attaching a dummy block having the same outer shape instead of the second pilot valve 7*b*, and locking the second manual button 18*b* in an operating state, thereby providing the single-pilot-type solenoid valve having essentially the same outer shape as the double-pilot-type solenoid valve.

In the event that a solenoid valve assembly is configured of the coupling solenoid valve 1 having the aforementioned configuration, as illustrated in FIG. 8, the plurality of solenoid valves 1, a port block 64 including an air supply port 64*a* and discharge port 64*b* for connection in bulk, a connector block 65 including a connector 66 for power supply in bulk, and an end block 67 positioned outside of the port block 64 are arrayed on the rail 45 such as shown in the drawing, and are sequentially coupled so as to be fixed on the rail 45. In FIG. 8, a state in which only a part of the solenoid valves 1 are mutually coupled, and connected with the hook 43 is illustrated, but all of the solenoid valves 1 and the aforementioned respective blocks 64, 65, and 67 are sequentially coupled, and mutually connected with the hook in the same way.

Therefore, the port block 64 positioned in the middle includes a movable binding member 70 having the same configuration as that provided in the solenoid valve 1, a hook 70*a*, which is formed under the binding member 70, protruding on the first coupling face side (right side in FIG. 8), and an engaging portion positioned on the second coupling face side (left side in FIG. 8), the end block 67 includes the movable binding member 70, the hook 70*a*, which is formed under the binding member 70, protruding on the first coupling face side, and the connector block 65 includes an engaging portion positioned on the second coupling face side. The hook 70*a* of the end block 67 is engaged with the engaging portion of the port block 64, the hook 70*a* of the port block 64 is engaged with the engaging portion 42 of the solenoid valve 1 positioned on one end of the solenoid valve array, and the hook 43 of the solenoid valve 1 positioned on the other end of the solenoid valve array is engaged with the engaging portion of the connector block.

Also, the plurality of coupling communication holes 15 and 16, the pilot supply communication hole 30, and the pilot discharge communication hole 60 are formed in the aforementioned respective blocks 64, 65, and 67, in the same way as the solenoid valve 1, and the corresponding communication holes are mutually connected, but while the aforementioned respective communication holes in the case of the port block 64 are formed so as to pass through the port block 64, the end portions of the respective communication holes in the case of the end block 67 and the connector block 65 are sealed within each block.

Figure 9:
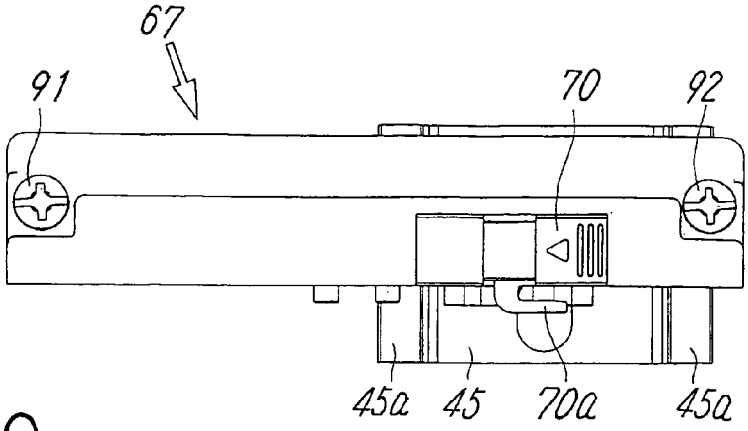
FIG. 9 is a top view of an end block.
Figure 10:
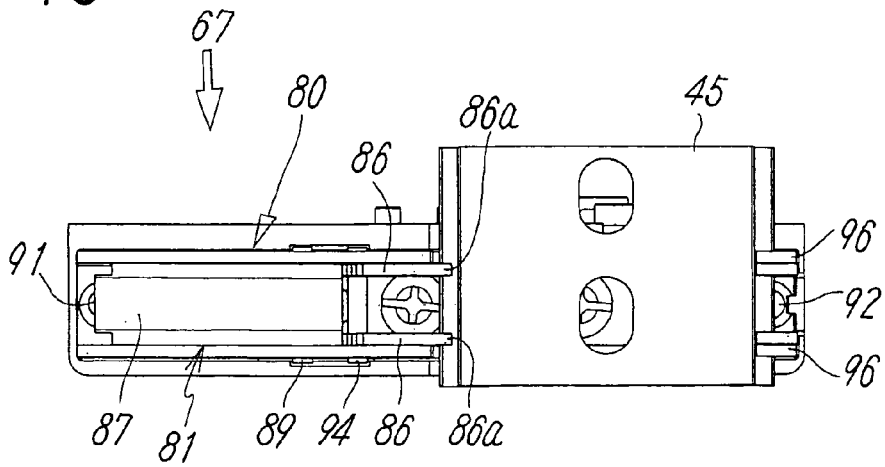
FIG. 10 is a bottom view of the end block.
Figure 11:
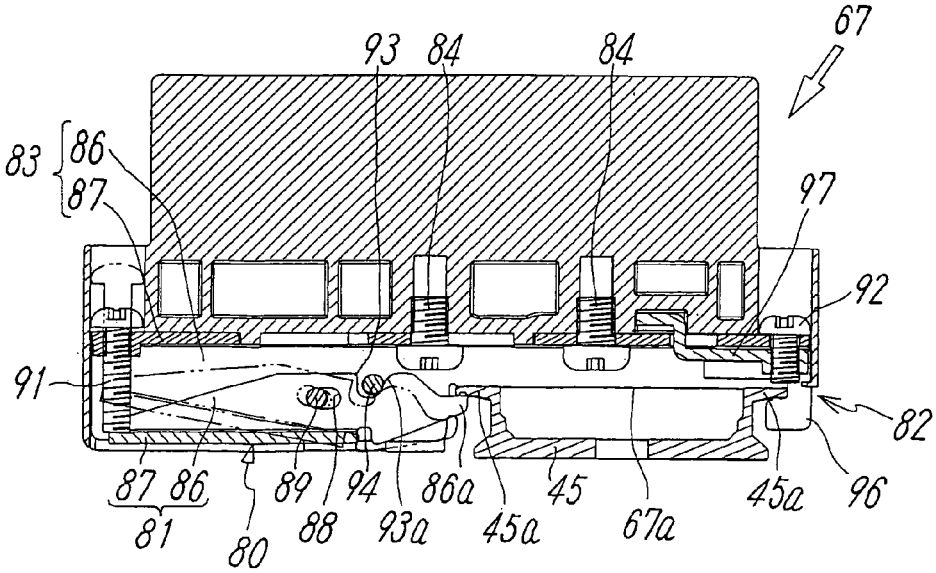
FIG. 11 is a cross-sectional view of the end block.

The respective solenoid valves 1 and the respective blocks 64, 65, and 67 are attached to the rail 45 by fixing the end block 67 and the connector block 65, which are positioned on both ends of the solenoid valve array, to the rail 45. In FIG. 9 through FIG. 11, a fixing mechanism 80 for fixing the end block 67 to the rail 45 is illustrated. The same fixing mechanism as this is provided with the connector block 65, but here, description will be made regarding the fixing mechanism 80 of the end block 67, and description will be omitted regarding the fixing mechanism of the connector block 65.

The fixing mechanism 80, which is disposed within a space portion formed in the bottom of the end block 67, includes a first fixing member 81 to be locked in one side of the flange portion 45*a* of the rail 45, and a second fixing member 82 to be locked in the other side of the flange portion 45*a*. These fixing members 81 and 82 are attached within a groove-shaped holder 83, and this holder 83 is detachably attached within the space portion of the end block 67 using a screw 84.

The first fixing member 81 is made up of a pair of left and right side frame pieces 86 and 86 extending in the axial direction of the end block 67, and bottom frame pieces 87 connecting the bottoms of both side frame pieces 86 and 86. A slot 88 extending in the longitudinal direction is formed in both side frame pieces 86 and 86, on the other hand, a supporting shaft 89 passing through the slot 88 is attached to both left and right side walls 83*a* and 83*a* of the holder 83, and the first fixing member 81 is attached to the holder 83 so as to turn on this supporting shaft 89. The tips of both side frame pieces 86 and 86 serve as locking portions 86*a*, which extend within a recessed-stage-shaped rail attachment portion 67*a* of the bottom of the end block 67 so as to be capable of detachably engaging with the flange portions 45*a* of the rail 45 from underneath.

On the other hand, a first fixing screw 91 is attached to the position corresponding to the rear end portion of the bottom frame piece 87 in the ceiling wall 86*b* of the holder 83 so as to advance and retreat vertically. When this first fixing screw 91 is fastened downward, the first fixing member 81 occupies the position illustrated in a solid line in FIG. 11 by the rear end portion of the bottom frame piece 87 being depressed, and the locking portions 86*a* and 86*a* of the tips of side frame pieces 86 and 86 are locked in the flange portions 45*a* of the rail 45, on the other hand, when the first fixing screw 91 is unfastened, as illustrated in a dashed line in FIG. 11, the first fixing member 81 turns centered on the supporting shaft 89 such that the locking portions 86*a* and 86*a* come out of the flange portions 45*a*. At this time, the following devices are arranged such that the first fixing member 81 retreats to the dashed line position, and the locking portions 86*a* and 86*a* completely come out of the flange portions 45*a*.

That is to say, a generally U-shaped recessed groove 93 is formed at a position closer to the tip than the slot 88 on the upper edges of both side frame pieces 86 and 86, and a groove edge 93*a* in front of the recessed groove 93 inclines in a direction gradually expanding upward. On the other hand, guide shafts 94 are attached to the left and right side walls 83*a* and 83*a* of the holder 83, and these guide shafts 94 are fitted in the recessed groove 93. When the first fixing screw 91 is unfastened so as to come out of the rail 45, the first fixing member 81 retreats to the dashed line position such that the locking portion 86*a* come out of the flange portions 45*a* by the inclining groove edge 93*a* of the recessed groove 93 moving along the guide shafts 94.

Also, the second fixing member 82 is made up of a pair of left and right fishhook-shaped locking pieces 96 and 96 extending from the end portion of the rail attachment 67*a* of the end block 67 downward, and an upper frame piece 97 connecting the upper ends of the locking pieces 96 and 96, and this upper frame piece 97 is attached to the ceiling wall 86*b* of the holder 83 with a second fixing screw 92 so as to move vertically. When this second fixing screw 92 is fastened, the locking pieces 96 and 96 are locked in the flange portion 45*a* of the rail 45 from underneath by the upper frame piece 97 being raised, on the other hand, when the second fixing screw 92 is unfastened, the locking pieces 96 and 96 come out of the flange portion 45*a* by the upper frame piece 97 moving downward.

Note that both double-pilot-type solenoid valves and single-pilot-type solenoid valves may be included as the plurality of solenoid valves.

The solenoid valves to which the present invention is applied are not restricted to the 5-port type; rather, a 3-port type for example, may be employed.

The invention claimed is:

1. A coupling solenoid valve of which both side faces in the valve-width direction correspond to a first coupling face and a second coupling face for being coupled with another solenoid valve, said coupling solenoid valve comprising:

a main valve unit including plurality of coupling communication holes passing through in the valve-width direction, a valve hole through which said coupling communication holes mutually communicate, and a spool for switching a channel accommodated within said valve hole; and a solenoid operating unit connected with said main valve unit;

wherein the housing of said main valve unit is divided into plurality of blocks having essentially the equivalent horizontal width, and includes a center block positioned in the center, and a synthetic resin bottom block connected to the bottom of said center block;

wherein said valve hole extending in the axial direction of said main valve unit is formed in said center block; and wherein said plurality of coupling communication holes are formed in said bottom block, and also a connection tube protruding from said respective coupling communication holes to one coupling face side is integrally formed in said bottom block, and further, circular seal members are applied on the position of the other coupling face side within said respective coupling communication holes, and said corresponding coupling communication holes are connected in an airtight manner by said connection tube and said seal members of the adjacent solenoid valves being fitted to each other when plurality of solenoid valves are coupled.

2. A coupling solenoid valve according to claim 1, wherein said bottom block includes circular recessed groove portions surrounding each connection tube on the coupling face on the side in which said connection tube is provided, and circular protruding wall portions surrounding said respective coupling communication holes on the coupling face on the opposite side; and wherein said protruding wall portions and said recessed groove portions of the adjacent solenoid valves are mutually fitted when plurality of solenoid valves are coupled.

3. A coupling solenoid valve according to claim 1, wherein said center block includes an end wall portion extending downward on a first end side in the axial direction, and said bottom block is connected to said center block so as to be positioned in the axial direction by one end of said bottom block being in contact with said end wall portion.

4. A coupling solenoid valve according to claim 2, wherein said center block includes an end wall portion extending downward on a first end side in the axial direction, and said bottom block is connected to said center block so as to be positioned in the axial direction by one end of said bottom block being in contact with said end wall portion.

5. A coupling solenoid valve according to claim 3, wherein steps having a different height in the valve-width direction are formed on the face with which said end wall portion and said bottom block are mutually in contact, and said bottom block is positioned in the valve-width direction due to contact of these steps.

6. A coupling solenoid valve according to claim 4, wherein steps having a different height in the valve-width direction are formed on the face with which said end wall portion and said bottom block are mutually in contact, and said bottom block is positioned in the valve-width direction due to contact of these steps.

7. A coupling solenoid valve according to claim 1, wherein an output block including output ports is attached to said first end side of said center block, a manual block including manual buttons for switching said spool manually is attached to the second end of the opposite side, and said solenoid operating unit is coupled with said center block via this manual block.

8. A coupling solenoid valve according to claim 2, wherein an output block including output ports is attached to said first end side of said center block, a manual block including manual buttons for switching said spool manually is attached to the second end of the opposite side, and said solenoid operating unit is coupled with said center block via this manual block.

9. A coupling solenoid valve according to claim 3, wherein an output block including output ports is attached to said first end side of said center block, a manual block including manual buttons for switching said spool manually is attached to the second end of the opposite side, and said solenoid operating unit is coupled with said center block via this manual block.

10. A coupling solenoid valve according to claim 4, wherein an output block including output ports is attached to said first end side of said center block, a manual block including manual buttons for switching said spool manually is attached to the second end of the opposite side, and said solenoid operating unit is coupled with said center block via this manual block.

11. A coupling solenoid valve according to claim 5, wherein an output block including output ports is attached to said first end side of said center block, a manual block including manual buttons for switching said spool manually is attached to the second end of the opposite side, and said solenoid operating unit is coupled with said center block via this manual block.

12. A coupling solenoid valve according to claim 6, wherein an output block including output ports is attached to said first end side of said center block, a manual block including manual buttons for switching said spool manually is attached to the second end of the opposite side, and said solenoid operating unit is coupled with said center block via this manual block.

* * * * *